US009377022B2

(12) United States Patent
Ignatiev et al.

(10) Patent No.: US 9,377,022 B2
(45) Date of Patent: Jun. 28, 2016

(54) RADIALLY COMPLIANT SCROLL COMPRESSOR

(71) Applicant: Emerson Climate Technologies, Inc., Sidney, OH (US)

(72) Inventors: Kirill M. Ignatiev, Sidney, OH (US); Su Xiaogeng, Suzhou (CN); Sun Qingfeng, Suzhou (CN); Ye Tao, Suzhou (CN)

(73) Assignee: Emerson Climate Technologies, Inc., Sidney, OH (US)

( * ) Notice: Subject to any disclaimer, the term of this patent is extended or adjusted under 35 U.S.C. 154(b) by 87 days.

(21) Appl. No.: 14/072,920

(22) Filed: Nov. 6, 2013

(65) Prior Publication Data

US 2014/0205484 A1 Jul. 24, 2014

Related U.S. Application Data

(60) Provisional application No. 61/818,593, filed on May 2, 2013.

(30) Foreign Application Priority Data

Jan. 8, 2013 (CN) ..... 2013 1 00061392
Jan. 8, 2013 (CN) ..... 2013 2 00084188

(51) Int. Cl.
*F03C 2/00* (2006.01)
*F03C 4/00* (2006.01)
(Continued)

(52) U.S. Cl.
CPC ..... *F04C 29/0057* (2013.01); *F01C 1/0215* (2013.01); *F04C 18/0215* (2013.01); *F04C 29/0021* (2013.01); *F04C 23/008* (2013.01); *F04C 2240/60* (2013.01); *F04C 2240/807* (2013.01)

(58) Field of Classification Search
CPC ..... F04C 2240/807; F04C 23/008; F04C 18/0215; F04C 29/0057; F04C 15/0042; F01C 1/0215
USPC ..... 418/55.1–55.6, 57, 151
See application file for complete search history.

(56) References Cited

U.S. PATENT DOCUMENTS 4,877,382 A * 10/1989 Caillat et al. ..... 418/55.5
5,040,958 A * 8/1991 Arata et al. ..... 418/55.5
(Continued)

FOREIGN PATENT DOCUMENTS

CN 1629486 A 6/2005
CN 101270751 A 9/2008
(Continued)

OTHER PUBLICATIONS

Office Action regarding Chinese Patent Application No. 201310006139.2, dated Sep. 1, 2015. Translation provided by Unitalen Attorneys at Law.

*Primary Examiner* — Theresa Trieu
(74) *Attorney, Agent, or Firm* — Harness, Dickey & Pierce, P.L.C.

(57) ABSTRACT

A compressor may include a compression mechanism, a driveshaft, and a lever. The compression mechanism may include orbiting and non-orbiting scroll members meshingly engaging each other. The driveshaft may include an eccentric crank pin engaging the orbiting scroll member such that rotation of the driveshaft about a first axis causes orbital motion of the orbiting scroll relative to the non-orbiting scroll. The lever may be mounted for rotation with the driveshaft about the first axis and may be rotatable relative to the driveshaft about a second axis.

32 Claims, 15 Drawing Sheets

(51) Int. Cl.

| | |
|---|---|
| ***F04C 2/00*** | (2006.01) |
| ***F04C 18/00*** | (2006.01) |
| ***F01C 21/00*** | (2006.01) |
| ***F04C 29/00*** | (2006.01) |
| ***F04C 18/02*** | (2006.01) |
| ***F01C 1/02*** | (2006.01) |
| *F04C 23/00* | (2006.01) |

(56) References Cited

U.S. PATENT DOCUMENTS

| | | | | |
|---|---|---|---|---|
| 5,520,527 A | 5/1996 | Kim | | |
| 5,531,577 A * | 7/1996 | Hayase et al. | ..... | 418/55.1 |
| 6,106,258 A * | 8/2000 | Kajiwara | ..... | F04C 18/0215 418/55.1 |
| 6,231,324 B1 * | 5/2001 | Clendenin et al. | ..... | 418/55.3 |
| 7,104,771 B2 * | 9/2006 | Choi | ..... | F04C 29/0057 418/151 |
| 2004/0219048 A1 * | 11/2004 | Tsuchiya et al. | ..... | 418/55.4 |

FOREIGN PATENT DOCUMENTS

| | | |
|---|---|---|
| CN | 203051113 U | 7/2013 |
| EP | 0849471 A4 | 8/1999 |
| JP | 3136820 B2 | 2/2001 |

* cited by examiner

RADIALLY COMPLIANT SCROLL COMPRESSOR

CROSS-REFERENCE TO RELATED APPLICATIONS

This application claims the benefit and priority of Chinese Application No. 201310006139.2, filed Jan. 8, 2013 and Chinese Application No. 201320008418.8, filed Jan. 8, 2013. This application also claims the benefit of U.S. Provisional Application No. 61/818,593, filed on May 2, 2013. The entire disclosures of each of the above applications are incorporated herein by reference.

FIELD

The present teachings relate generally to scroll compressors and, more particularly, to radially compliant scroll compressors.

BACKGROUND

This section provides background information related to the present disclosure and is not necessarily prior art.

A scroll compressor can compress a fluid from a suction pressure to a discharge pressure greater than the suction pressure. The scroll compressor can use a non-orbiting scroll member and an orbiting scroll member, each having a wrap positioned in meshing engagement with one another. The relative movement between the scroll members causes the fluid pressure to increase as the fluid moves from the suction port to the discharge port. To improve efficiency, the orbiting and non-orbiting scroll members are designed to be in a uniform, but light, contact with each other to maintain sealing therebetween.

Radial compliance of a scroll compressor allows for sealing of the wraps during compressor operation by enabling them to touch each other by compensating the effect of misalignment or shaft and bearing deflection. While scroll inertial force brings the wraps together, at certain compressor sizes and operational conditions, the scroll inertial force may result in friction and power loss.

A radial sealing force between a wrap of the non-orbiting scroll and a wrap of the orbiting scroll may be provided by a centrifugal force generated by orbiting movement of the orbiting scroll. The centrifugal force of the orbiting scroll may be related to a rotating speed of a drive mechanism that drives the orbiting scroll (e.g., a motor). Therefore, when the rotating speed of the motor is relatively low, the radial sealing force may be too small to provide effective sealing of compression chambers between the wraps. Further, when the rotating speed of the motor is sufficiently high, the radial sealing force may be high enough to damage the wraps.

SUMMARY

This section provides a general summary of the disclosure, and is not a comprehensive disclosure of its full scope or all of its features.

In one form, the present disclosure provides a compressor including orbiting and non-orbiting scrolls, a driveshaft and a leverage mechanism. The non-orbiting scroll component may include a first end plate and a first spiral wrap. The orbiting scroll may include a second end plate, a second spiral wrap formed at one side of the second end plate, and a hub formed at the other side of the second end plate. The driveshaft may include an eccentric crank pin drivingly engaging the hub of the orbiting scroll. The leverage mechanism may be rotatable with the driveshaft. A centrifugal force generated by the rotation of the leverage mechanism may be transmitted to the orbiting scroll so as to at least partially counteract a centrifugal force of the orbiting scroll.

In some embodiments, the eccentric crank pin of the driveshaft may include a groove in which the leverage mechanism is at least partially disposed.

In some embodiments, the groove may extend in a first direction parallel to an axis about which the driveshaft rotates.

In some embodiments, the leverage mechanism may include a counterweight component. At least a portion of the counterweight component may be provided in the groove. The counterweight component may be able to swing relative to the driveshaft about a pivot point.

In some embodiments, the counterweight component may include a contact point for transmitting the centrifugal force to the orbiting scroll. The contact point may be located between the pivot point and a center of gravity of the counterweight component.

In some embodiments, the pivot point may be located at a distal end of the eccentric crank pin facing the end plate of the orbiting scroll.

In some embodiments, the counterweight component may include a pivot end and a free end. The pivot end may be pivotally connected to the distal end of the eccentric crank pin.

In some embodiments, the counterweight component may be a generally L-shaped structure having a long arm substantially extending in a first direction and a short arm substantially extending in a second direction substantially perpendicular to the first direction.

In some embodiments, the long arm of the L-shaped structure may include a bent portion such that the center of gravity of the counterweight component may be offset outwardly in the second direction.

In some embodiments, the groove may have a shape substantially corresponding to the counterweight component.

In some embodiments, the counterweight component may include a contact point for transmitting the centrifugal force to the orbiting scroll component. A center of gravity of the counterweight component may be located between the contact point and the pivot point.

In some embodiments, the pivot point may be located away from a distal end of the eccentric crank pin facing the end plate of the orbiting scroll.

In some embodiments, the compressor may also include a second counterweight connected to the counterweight component.

In some embodiments, an unloader bushing may be provided between the eccentric crank pin and the hub of the orbiting scroll.

In some embodiments, the contact point of the counterweight component may transmit the centrifugal force to the hub of the orbiting scroll component via the unloader bushing.

In some embodiments, a journal portion of the driveshaft supported by a main bearing housing may be provided with a sleeve to cover a portion of the groove.

In some embodiments, a predetermined radial clearance may be provided between the counterweight component and the sleeve.

In some embodiments, a main bearing is provided in the main bearing housing to support the driveshaft. The sleeve may be located between the driveshaft and the main bearing.

In some embodiments, the eccentric crank pin may include a flat portion extending parallel to the rotating axis of the driveshaft. A predetermined angle may be provided between a plane at which the groove is located and a plane at which the flat portion is located.

In some embodiments, the predetermined angle may be sized such that a radial sealing force between the wraps is only provided by a radial component of a driving force determined by the predetermined angle, regardless of the centrifugal force of the orbiting scroll component.

In some embodiments, a direction of the centrifugal force provided by the leverage mechanism may be substantially opposite to a direction of the centrifugal force of the orbiting scroll.

In some embodiments, an acting force transmitted to the orbiting scroll by the leverage mechanism may be substantially equal to the centrifugal force of the orbiting scroll component.

In some embodiments, the center of gravity of the counterweight component and a center of gravity of the orbiting scroll may be located on opposing sides of the axis of rotation of the driveshaft.

In another form, the present disclosure provides a scroll compressor that reduces scroll inertial force carried onto the wraps while allowing for radial compliance advantages. The compressor may include a shell, first and second scroll members, and a counterweight assembly. The first scroll member may include a discharge port and a first spiral wrap. The second scroll member may include a second spiral wrap and may be mounted for orbital movement relative to the first scroll member. The first and second spiral wraps may be mutually intermeshed.

A first counterweight can be mounted for the rotational movement with a driveshaft. The first counterweight may produce a first counterforce that acts against an inertial force of the second scroll member. A second counterweight may be mounted for movement relative to the first counterweight. The second counterweight may produce a second counterforce that acts against the inertial force of the second scroll member.

The driveshaft may include an eccentric drive pin that is received within a cylindrical drive hub defined on the second scroll member. An unloader bushing may be disposed radially between the eccentric drive pin and the cylindrical hub. A lever may be captured between the eccentric drive pin and the unloader bushing. The lever may be pivotally coupled to the second counterweight such that movement of the second counterweight causes rotation of the lever.

In another form, the present disclosure provides a compressor that may include a compression mechanism, a driveshaft, and a lever. The compression mechanism may include orbiting and non-orbiting scroll members meshingly engaging each other. The driveshaft may include an eccentric crank pin engaging the orbiting scroll member such that rotation of the driveshaft about a first axis causes orbital motion of the orbiting scroll relative to the non-orbiting scroll. The lever may be mounted for rotation with the driveshaft about the first axis and may be rotatable relative to the driveshaft about a second axis that is perpendicular to the first axis.

In another form, the present disclosure provides a compressor that may include orbiting and non-orbiting scroll members, a driveshaft, and a counterweight. The orbiting scroll member may be intermeshed with the non-orbiting scroll member. The driveshaft may drivingly engage the orbiting scroll. The counterweight may be mounted for radial movement relative to the driveshaft and the orbiting scroll member and may produce a counterforce that acts against an inertial force of the orbiting scroll member.

In another form, the present disclosure provides a compressor that may include orbiting and non-orbiting scroll members and first and second counterweights. The orbiting scroll member may be mounted for orbital movement relative to the non-orbiting scroll member. The first counterweight may be mounted for movement with the orbiting scroll member and may produce a first counterforce that acts against an inertial force of the orbiting scroll member during orbital movement of the orbiting scroll member. The second counterweight may be mounted for movement relative to the first counterweight and may produce a second counterforce that acts against the inertial force of the orbiting scroll member during orbital movement of the orbiting scroll member.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present teachings in any way.

DETAILED DESCRIPTION

Figure 1:
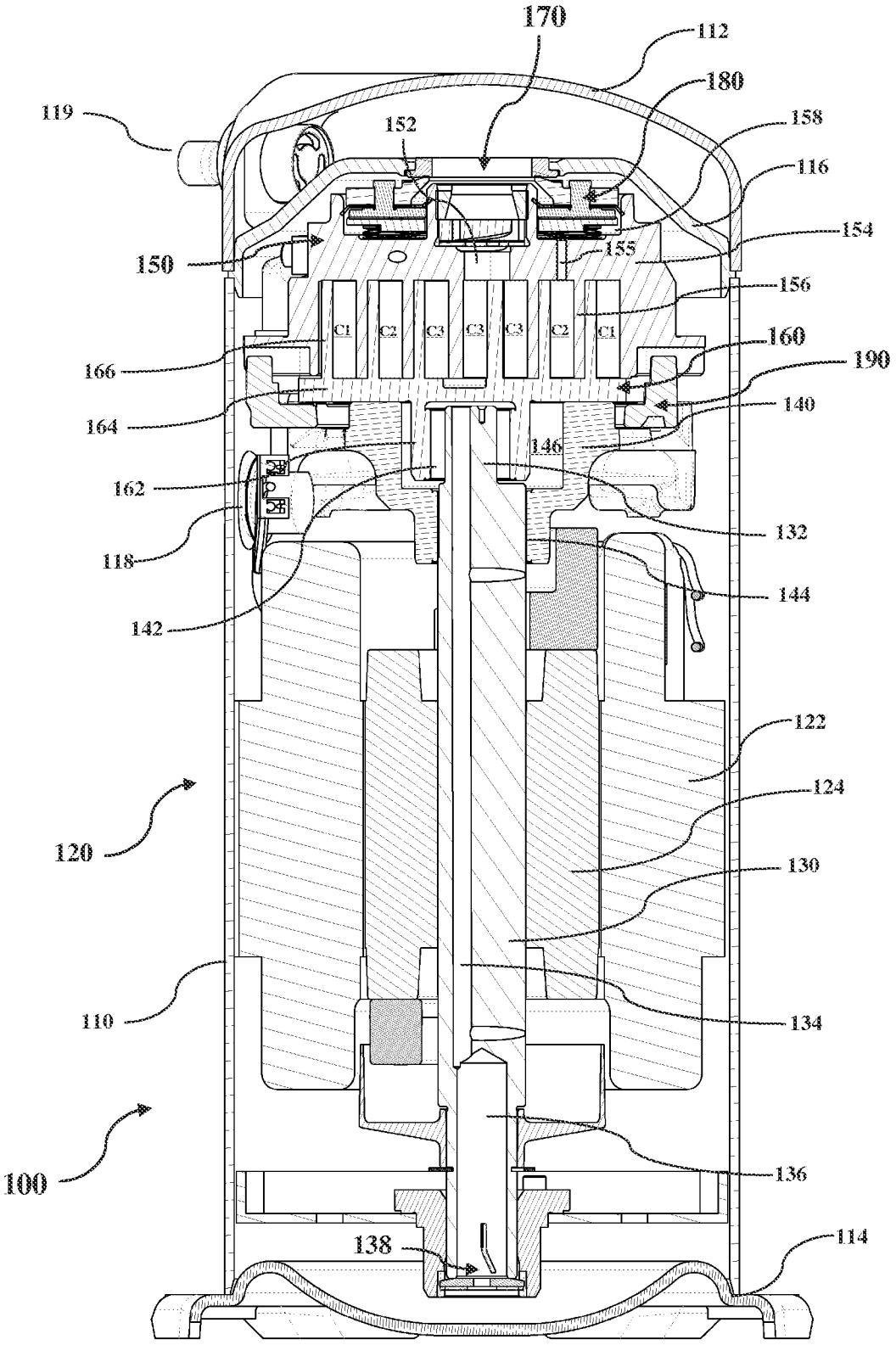
FIG. 1 is a cross-sectional view of a scroll compressor.

The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a scroll compressor 100 is provided that may include a shell 110, a top cover 112 provided on one end of the shell 110, a bottom cover 114 provided on the other end of the shell 110, and a partition 116 provided between the top cover 112 and the shell 110 for partitioning an inner space of the scroll compressor 100 into a high side and a low side. The space between the partition 116 and the top cover 112 forms the high side, and the space between the partition 116, the shell 110 and the bottom cover 114 forms the low side. A suction inlet fitting 118 for receiving suction-pressure fluid may be provided at the low side, and an outlet fitting 119 for discharging compressed fluid is provided at the high side.

A motor 120 having a stator 122 and a rotor 124 may be provided in the shell 110. A driveshaft 130 may be fixed within the rotor 124 to drive an orbiting scroll 160 relative to a non-orbiting scroll 150.

The orbiting scroll 160 may include an end plate 164, a hub 162 formed at one side of the end plate 164, and a spiral wrap 166 formed at the other side of the end plate 164. The non-orbiting scroll 150 may include an end plate 154, a spiral wrap 156 formed at one side of the end plate 154, and a discharge port 152 substantially formed at a center of the end plate 154. A series of compression chambers C1, C2 and C3, whose volumes are gradually reduced from a radially outer position to a radially inner position, are formed between the spiral wrap 156 of the non-orbiting scroll 150 and the spiral wrap 166 of the orbiting scroll 160. The radially outermost compression chamber C1 may be at a suction pressure, and the radial innermost compression chamber C3 may be at a discharge pressure. The middle compression chamber C2 may be at a pressure between the suction pressure and the discharge pressure, and thus is also referred to as an intermediate-pressure chamber.

One side of the orbiting scroll 160 is supported by an upper portion (which forms a thrust surface) of a main bearing housing 140. A portion of the driveshaft 130 is supported by a main bearing 144 provided in the main bearing housing 140. The driveshaft 130 may include an eccentric crank pin 132 at one end thereof. An unloader bushing 142 may be provided between the eccentric crank pin 132 and the hub 162 of the orbiting scroll 160. Driven by the motor 120, the orbiting scroll 160 may orbit relative to the non-orbiting scroll 150 (i.e. a central axis of the orbiting scroll 160 rotates around a central axis of the non-orbiting scroll 150, however the orbiting scroll 160 does not rotate around its own central axis), so as to compress the fluid. The relative orbiting movement between the orbiting scroll 160 and the non-orbiting scroll 150 is realized by an Oldham coupling 190 that may be provided between the non-orbiting scroll 150 and the orbiting scroll 160. The fluid compressed by the non-orbiting scroll 150 and the orbiting scroll 160 may be discharged to the high side via the discharge port 152. A one-way valve or a discharge valve 170 may be provided at the discharge port 152 to restrict or prevent the fluid at the high side from flowing back to the low side via the discharge port 152.

Lubricant may be stored at a bottom portion of the shell 110 of the compressor 100. The driveshaft 130 may include a central hole 136 formed at a lower end thereof and an eccentric hole 134 extending upwardly from the central hole 136 to an end surface of the eccentric crank pin 132. An end portion of the central hole 136 may be immerged in the lubricant at the bottom portion of the shell 110 of the compressor 100 or may be supplied with lubricant in other manners. In one example, a lubricant supplying device, for example an oil pump or an oil fork 138 as shown in FIG. 1, may be provided in the central hole 136 or at the end portion of the central hole 136. During the operation of the compressor 100, one end of the central hole 136 is supplied with lubricant by the lubricant supplying device. Under the action of the centrifugal force generated by the rotation of the driveshaft 130, the lubricant entered in the central hole 136 is pumped into the eccentric hole 134 and then flows upwardly to the end surface of the eccentric crank pin 132 along the eccentric hole 134. The lubricant discharged from the end surface of the eccentric crank pin 132 may flow downwardly to a recess portion 146 of the main bearing housing 140 via a clearance between the unloader bushing 142 and the eccentric crank pin 132 and a clearance between the unloader bushing 142 and the hub 162. A portion of the lubricant accumulated in the recess portion 146 may pass through the main bearing 144 and flow downwardly. A portion of the lubricant being stirred by the hub 162 may flow upwardly to a lower side of the end plate 164 of the orbiting scroll 160 and may be spread all over the thrust surface between the orbiting scroll 160 and the main bearing housing 140 by the orbiting movement of the orbiting scroll 160.

During the operation of the compressor 100, lubricant supplied to various moving components in the compressor 100 may be flung and/or splashed to form liquid drops or fog. These lubricant liquid drops or fog may be mixed in the working fluid (e.g., refrigerant) that is drawn into the shell 110 through the suction inlet fitting 118. Then, the working fluid mixed with the lubricant liquid drops may be drawn into compression chambers between the non-orbiting scroll 150 and the orbiting scroll 160 to lubricate, seal and cool the non-orbiting scroll 150 and the orbiting scroll 160.

In the scroll compressor 100, an effective sealing is provided between the non-orbiting scroll 150 and the orbiting scroll 160 so that the working fluid may be the compressed therebetween. An axial sealing may be provided between a top end of the spiral wrap 156 of the non-orbiting scroll 150 and the end plate 164 of the orbiting scroll 160 and between a top end of the spiral wrap 166 of the orbiting scroll 160 and the end plate 154 of the non-orbiting scroll 150.

A backpressure chamber 158 may be provided at a side of the end plate 154 of the non-orbiting scroll 150 opposite to the spiral wrap 156. A sealing assembly 180 may be provided in the backpressure chamber 158. An axial displacement of the sealing assembly 180 may be limited by the partition 116. The backpressure chamber 158 may be in fluid communication with one of the compression chambers, such as the intermediate-pressure chamber C2, via an axially extending through hole 155 formed in the end plate 154 so as to generate a force for pressing the non-orbiting scroll 150 toward the orbiting scroll 160. Since one side of the orbiting scroll 160 may be supported by an upper portion of the main bearing housing 140, the non-orbiting scroll 150 and the orbiting scroll 160 may be effectively pressed together by the pressure in the backpressure chamber 158. When pressure in the respective compression chambers exceeds a predetermined value, a resultant force produced by the pressure in the compression chambers may exceed a downward pressing force provided by the backpressure chamber 158 so as to move the non-orbiting scroll 150 upwardly. At this time, the fluid in the compression chambers may be leaked to the low side via a clearance between the top end of the spiral wrap 156 of the non-orbiting scroll 150 and the end plate 164 of the orbiting scroll 160 and a clearance between the top end of the spiral wrap 166 of the orbiting scroll 160 and the end plate 154 of the non-orbiting scroll 150.

A radial sealing may also be provided between a side surface of the spiral wrap 156 of the non-orbiting scroll 150 and a side surface of the spiral wrap 166 of the orbiting scroll 160. The radial sealing between the above two wraps 156, 166 may be realized by a centrifugal force generated by the orbiting scroll 160 during orbital motion of the orbiting scroll 160 and a driving force provided by the driveshaft 130. In particular, during the operation of the compressor 100, the orbiting scroll 160 may orbit relative to the non-orbiting scroll 150, and thus the orbiting scroll 160 may generate the centrifugal force. The eccentric crank pin 132 of the driveshaft 130 may also generate a driving force component which may facilitate the radial sealing between the non-orbiting scroll 150 and the orbiting scroll 160. Due to the above centrifugal force and the driving force component, the spiral wrap 166 of the orbiting scroll 160 abuts against the spiral wrap 156 of the non-orbiting scroll 150, thereby realizing the radial sealing between the non-orbiting scroll 150 and the orbiting scroll 160. When an incompressible substance (such as solid impurities, lubricant and liquid refrigerant) enters the compression chambers between the spiral wrap 156 and the spiral wrap 166, the spiral wrap 156 and the spiral wrap 166 may be temporarily radially separated from each other to allow the passage of the foreign substance, thereby preventing damage to the spiral wraps 156, 166. The radial separation ability provides a radial compliance for the scroll compressor 100 and improves the reliability of the scroll compressor 100.

Figure 2:
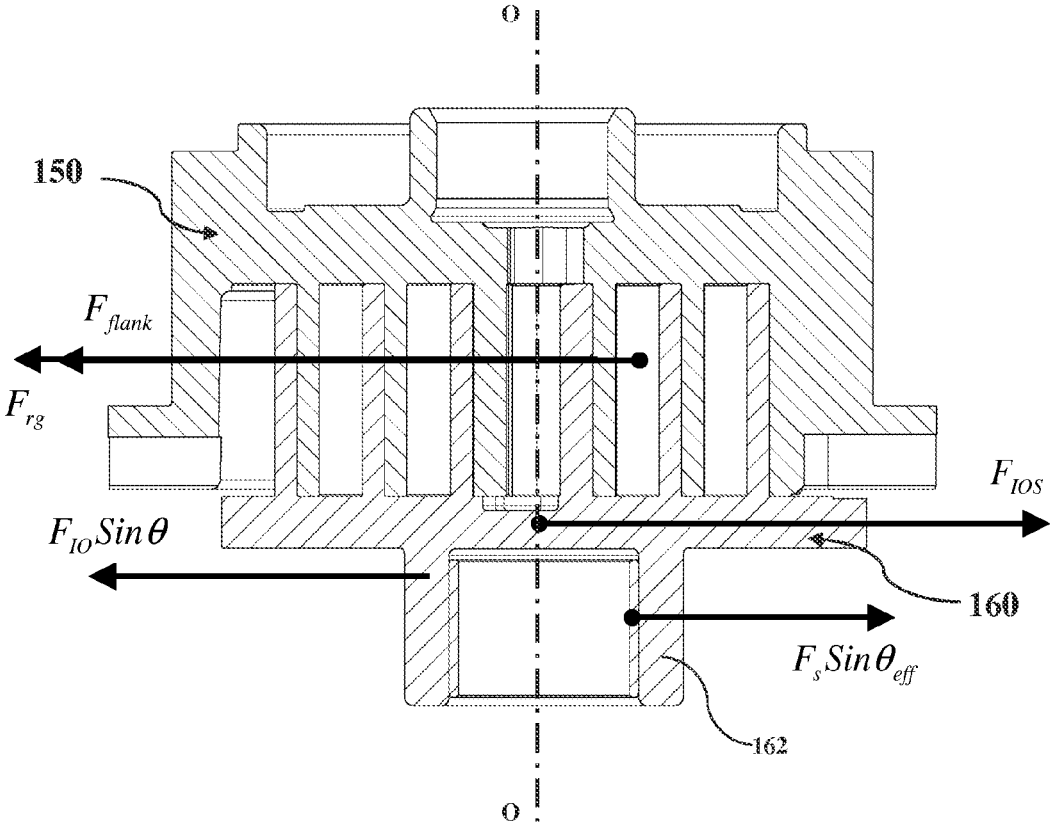
FIG. 2 is a cross-sectional view of orbiting and non-orbiting scrolls of the compressor of FIG. 1 depicting a radial sealing force between the orbiting and non-orbiting scrolls.

The above manner for realizing the radial sealing via the centrifugal force may have the following problems for variable-speed compressors. FIG. 2 depicts the radial sealing force between the non-orbiting scroll 150 and the orbiting scroll 160. As shown in FIG. 2, a total radial sealing force between the non-orbiting scroll 150 and the orbiting scroll 160 may be expressed by the following formula:

$$F_{flank}=F_{IOS}+F_s \operatorname{Sin} \theta_{eff}=F_{IO}*\operatorname{Sin} \theta-F_{rg} \qquad \text{Formula (1);}$$

where $F_{flank}$ is the total radial sealing force between the non-orbiting scroll 150 and the orbiting scroll 160; $F_{IOS}$ is the centrifugal force of the orbiting scroll 160; $F_s$ Sin $\theta_{eff}$ is a radial component of the driving force provided by the eccentric crank pin 132 (i.e. the centrifugal force component), wherein $F_s$ is the driving force provided by the eccentric crank pin 132, and $\theta_{eff}$ is an effective driving angle of the eccentric crank pin 132; $F_{IO}$*Sin θ is a centrifugal force component provided by the Oldham coupling 190, wherein $F_{IO}$ is the centrifugal force provided by the Oldham coupling 190 and θ is an orientation angle of the orbiting scroll 160 relative to the non-orbiting scroll 150; and $F_{rg}$ is a radial gas force provided by the fluid in the compression chambers.

$F_{IOS}$ and $F_{IO}$*Sin θ are related to the rotating speed of the driveshaft 130, however $F_s$ Sin $\theta_{eff}$ and $F_{rg}$ are irrelevant to the rotating speed of the driveshaft 130. Thus, the radial sealing force $F_{flank}$ is relevant to the rotating speed of the driveshaft 130. That is to say, the higher the rotating speed of the driveshaft 130, the greater the radial sealing force $F_{flank}$ is; and the lower the rotating speed of the driveshaft 130, the smaller the radial sealing force $F_{flank}$ is. Thus, when the scroll compressor 100 is in a working condition of low rotating speed, the radial sealing force $F_{flank}$ between the non-orbiting scroll 150 and the orbiting scroll 160 may be insufficient, thereby causing the low efficiency of the compressor. When the scroll compressor 100 is in a working condition of high rotating speed, the radial sealing force $F_{flank}$ between the non-orbiting scroll 150 and the orbiting scroll 160 may be excessive high, which may cause excessive wear of the scrolls 150, 160 and/or damage to the wraps 156, 166.

In view of the above problems, the present disclosure is made. One object of the present disclosure is to reduce or even eliminate the effect of the rotating speed of the driveshaft (or the motor) on the radial sealing force between the non-orbiting scroll 150 and the orbiting scroll 160 as far as possible.

With reference to FIGS. 3-7, another scroll compressor is provided that may include a leverage mechanism 40 that may reduce or eliminate the effect of rotating speed of the driveshaft (or motor) on the radial sealing force between orbiting and non-orbiting scrolls. Like numerals and letters are used in FIGS. 3-7 to indicate the like components in FIGS. 1 and 2, and thus these components will not be described again in detail.

Figure 3:
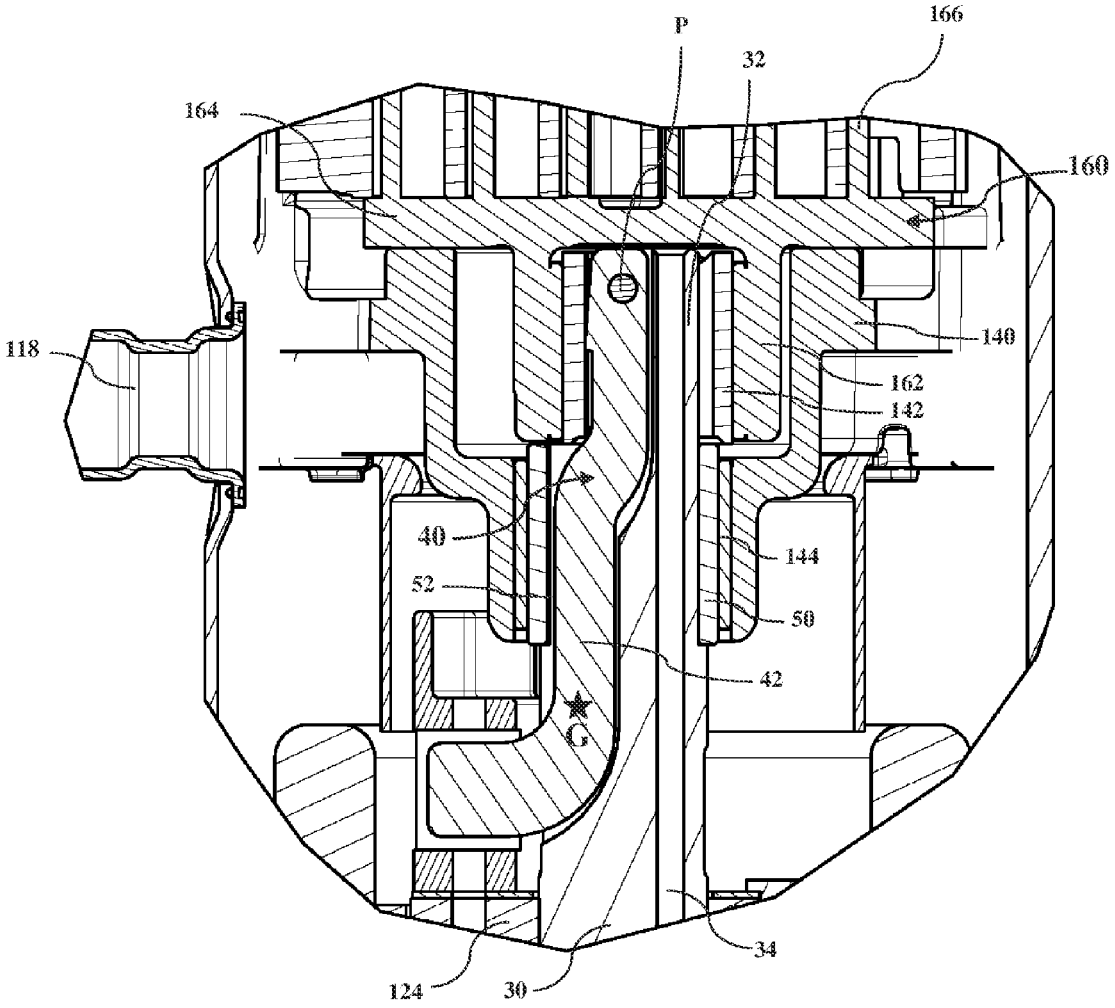
FIG. 3 is a partial cross-sectional view of another scroll compressor having a leverage mechanism according to the principles of the present disclosure.
Figure 4:
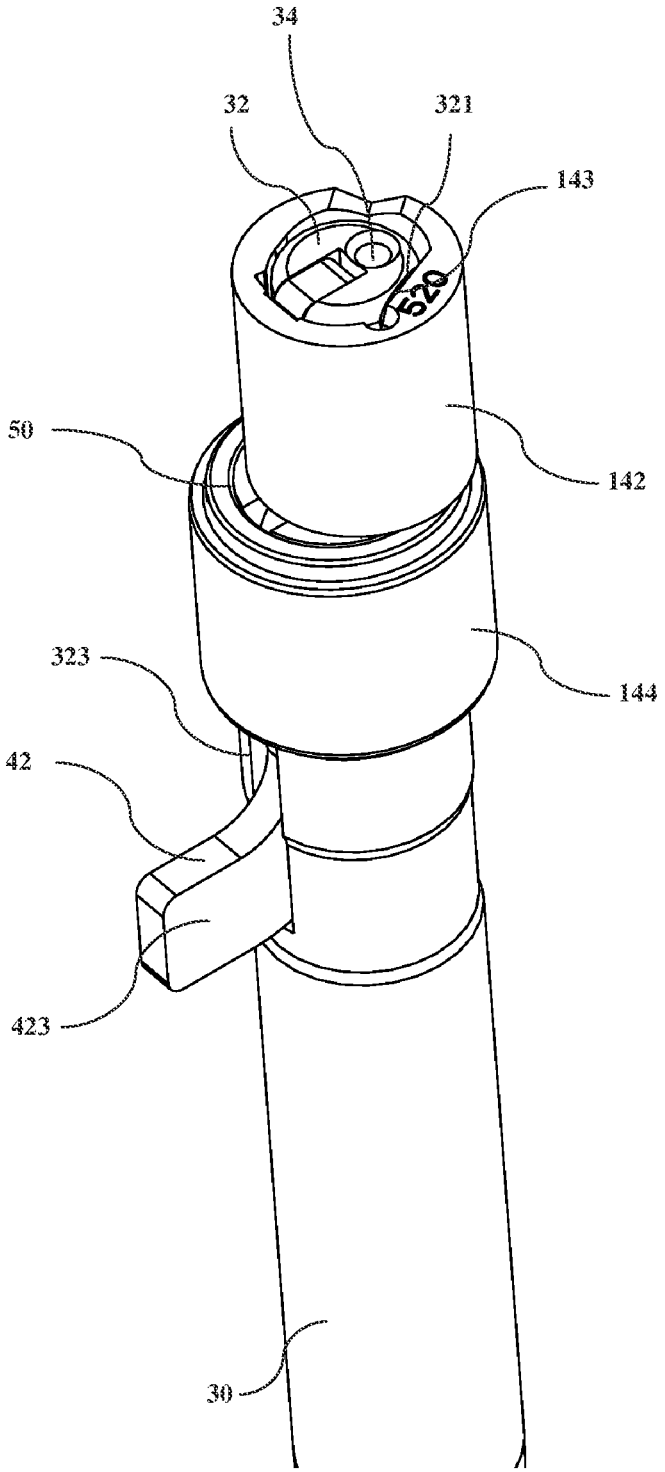
FIG. 4 is an partial perspective view of the leverage mechanism according to the first embodiment of FIG. 3.
Figure 5:
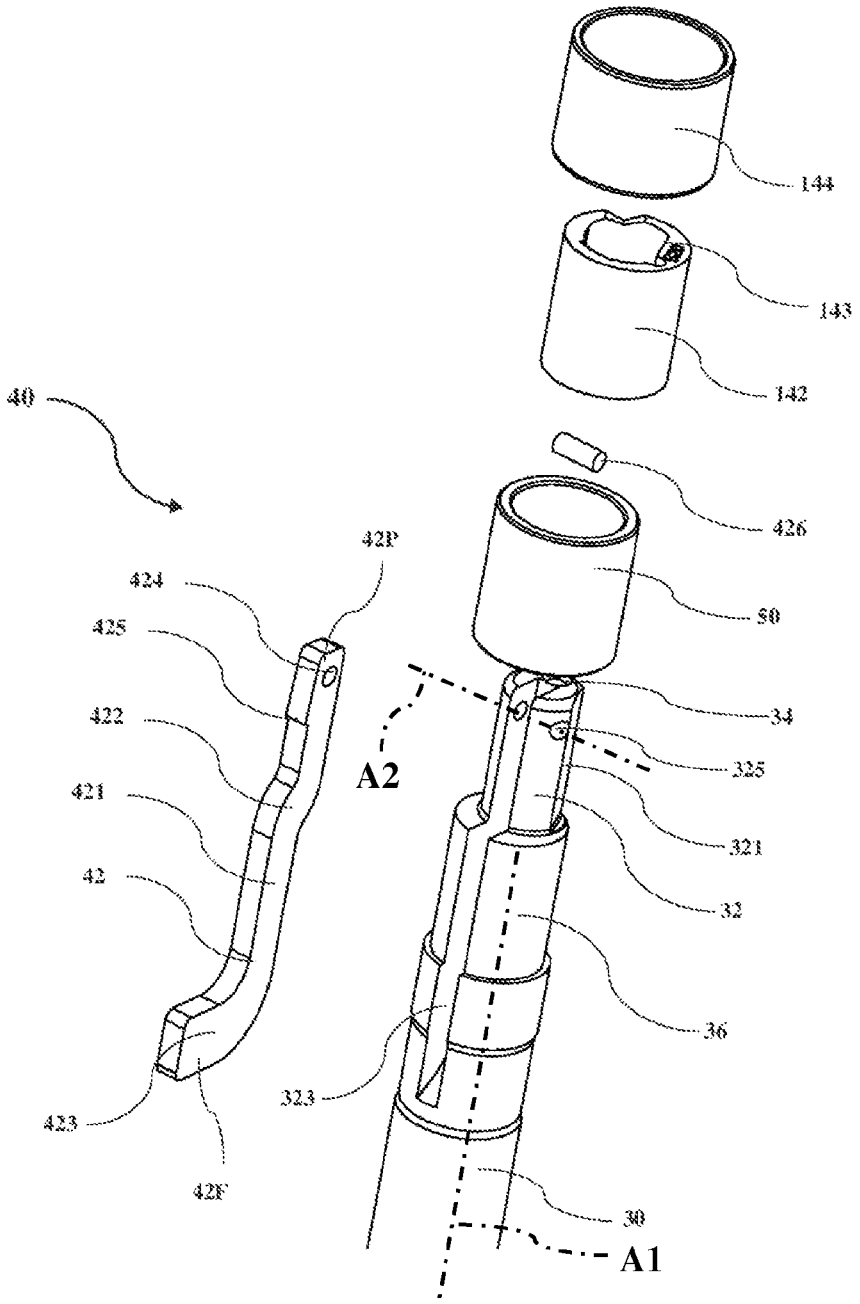
FIG. 5 is an exploded perspective view of the leverage mechanism.

As shown in FIG. 3, a driveshaft 30 is fixed within in the rotor 124 so as to drive the orbiting scroll 160 relative to the non-orbiting scroll 150, as described above. One end of the driveshaft 30 includes an eccentric crank pin 32. An eccentric hole 34 substantially extending in a first direction (a longitudinal direction) parallel to a rotating axis A1 of the driveshaft 30 is formed in the driveshaft 30 so as to supply lubricant to an end portion of the eccentric crank pin 32. The eccentric crank pin 32 of the driveshaft 30 is fit in the hub 162 of the orbiting scroll 160 via the unloader bushing 142. As shown in FIGS. 4 and 5, the eccentric crank pin 32 includes a flat portion 321 extending parallel to the rotating axis A1 of the driveshaft 30. Accordingly, a substantially D-shaped hole of the unloader bushing 142 through which the eccentric crank pin 32 passes includes a flat portion 143 which may fit with the flat portion 321 of the eccentric crank pin 32. In the radial direction parallel to the flat portion 143, the substantially D-shaped hole of the unloader bushing 142 has a dimension larger than a dimension of the eccentric crank pin so as to ensure the radial compliance between the orbiting scroll 160 and the non-orbiting scroll 150.

The leverage mechanism 40 is configured to be rotatable with the driveshaft 30. A centrifugal force generated by the rotation of the leverage mechanism 40 may be transmitted to the orbiting scroll 160, thereby partially or completely counteracting a centrifugal force of the orbiting scroll 160.

The end portion of the driveshaft 30 provided with the eccentric crank pin 32 may include a groove 323 in which the leverage mechanism 40 may be received. The groove 323 may extend in a first direction parallel to the rotating axis of the driveshaft 30. Or, in other words, a plane at which the groove 323 is located may be parallel to the rotating axis of the driveshaft 30. Further, the leverage mechanism 40 may include a counterweight component 42. At least a portion of the counterweight component 42 may be provided in the groove 323, and the counterweight component 42 may swing relative to the driveshaft 30 about a pivot point P. A center of gravity G of the counterweight component 42 and a center of gravity of the orbiting scroll 160 may be disposed on opposing sides of the rotating axis of the driveshaft 30.

Figure 6:
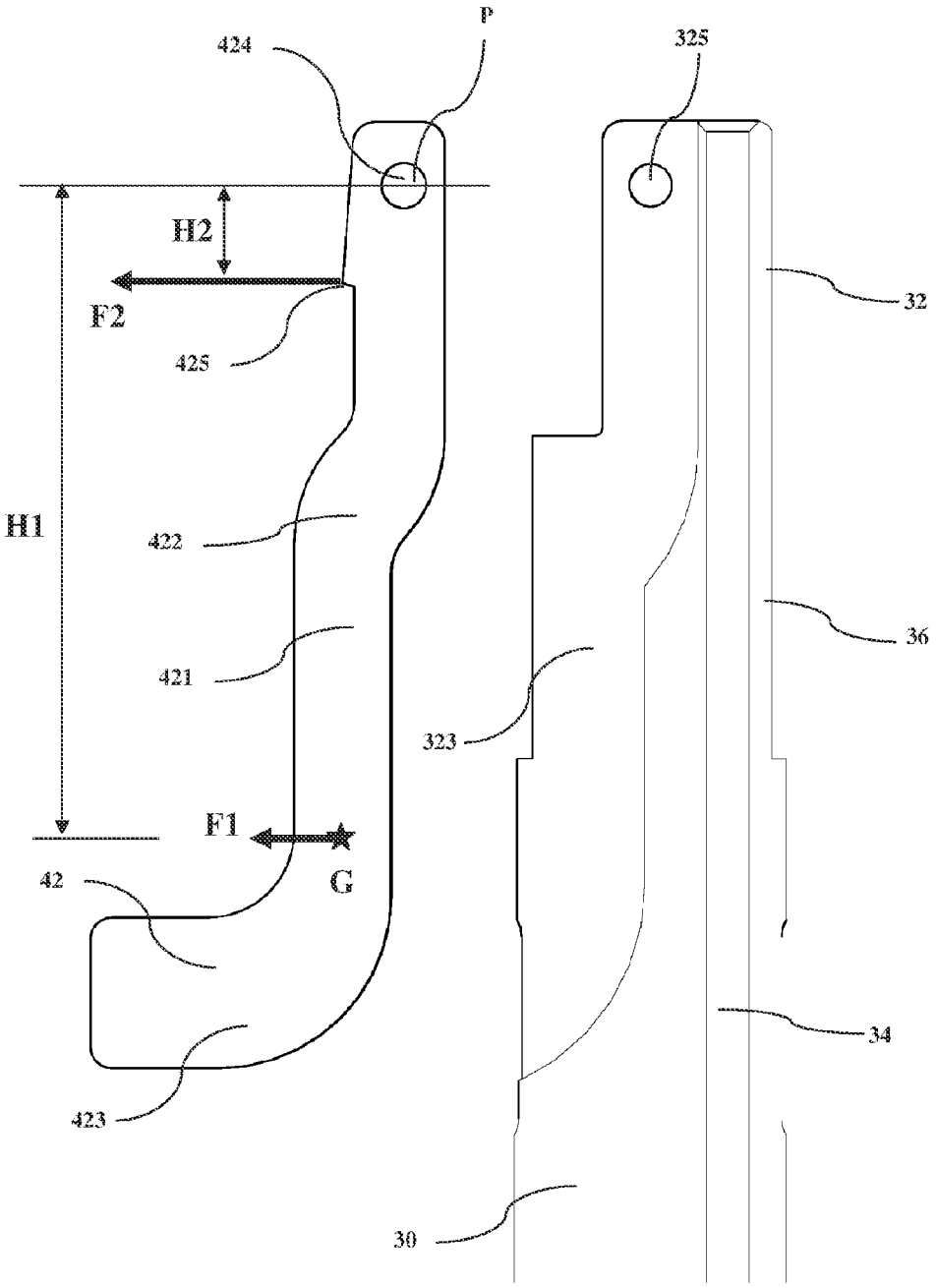
FIG. 6 is an exploded side view of a counterweight component and a driveshaft.

In the configuration shown in FIGS. 3-6, the counterweight component 42 includes a substantially L-shaped structure. The L-shaped structure has a long arm 421 substantially extending in the first direction parallel to the rotating axis of the driveshaft 30, and a short arm 423 substantially extending in a second direction substantially perpendicular to the first direction. The long arm 421 of the L-shaped structure may also include a bent portion 422 such that the center of gravity G of the counterweight component 42 may be offset outwardly in the second direction. As shown in FIG. 6, the groove 323 may include a shape substantially corresponding to the counterweight component 42. The counterweight component 42 may also include a contact point (or a contact portion) 425 for transmitting the centrifugal force to the orbiting scroll 160. More specifically, the contact point 425 of the counterweight component 42 transmits the centrifugal force to the hub 162 of the orbiting scroll 160 via the unloader bushing 142. It will be appreciated that the shape of the counterweight component 42 is not limited to the shape shown in the figures. Rather, the shape and position of the center of gravity of the counterweight component 42 can be designed and modified based on the position relationship of other components of the compressor. For example, a length of the short arm 423 may be shortened and a thickness thereof may be increased and/or the bent portion 422 of the long arm 421 may be shaped differently or omitted.

In the configuration shown in FIGS. 3-7, the contact point 425 is located between the gravity center G of the counterweight component 42 and the pivot point P. The pivot point P may be located at or adjacent to a distal end (i.e. the end facing the end plate of the orbiting scroll component) of the eccentric crank pin 32. In the structure, the pivot point P can be realized by a pin-hole fit between the counterweight component 42 and the eccentric crank pin 32. For example, the counterweight component 42 may include a pivot end 42P and a free end 42F. The pivot end 42P of the counterweight component 42 may include a hole 424, and the distal end of the eccentric crank pin 32 may include a corresponding hole 325. The counterweight component 42 may be pivotally provided at the distal end of the eccentric crank pin 32 of the driveshaft 30 via a pin 426 passing through the holes 325 and 424. In this manner, the counterweight component 42 is rotatably about a second axis A2 (FIG. 5) extending through the hole 325.

A journal portion 36 of the driveshaft 30 supported by the main bearing housing 140 may be provided with a sleeve 50 to cover a portion of the groove 323. Further, a main bearing 144 is provided in the main bearing housing 140 to support the driveshaft 30. The sleeve 50 is located between the driveshaft 30 and the main bearing 144. As shown in FIG. 3, a predetermined radial clearance 52 may be provided between the counterweight component 42 and the sleeve 50 to allow the counterweight component 42 to swing outward radially.

With continued reference to FIGS. 3-7, operation of the leverage mechanism 40 will be described in detail. Since the counterweight component 42 is attached to the driveshaft 30 via the pin 426, the counterweight component 42 may rotate with the driveshaft 30. At the same time, since the counterweight component 42 may rotate around the pin 426 (i.e. the pivot point P), the counterweight component 42 may swing outward under the action of the centrifugal force when the counterweight component 42 is rotating with the driveshaft 30.

As shown in FIG. 6, assuming that a centrifugal force generated by the rotating counterweight component 42 is F1, an acting force transmitted to the orbiting scroll 160 via the contact point 425 is F2, a distance between the center of gravity G of the counterweight component 42 and the pivot point P is H1, a distance between the contact point 425 and the pivot point P is H2, and it can be known according to the leverage principle that the relationship between the above parameters is F1*H1=F2*H2, i.e. F2=F1*(H1/H2). It can be known from the above formula that a desirable value of the F2 may be obtained by appropriately determining at least one parameter of H1, H2 and F1. Particularly, in the present example, since H1 is larger than H2, the leverage mechanism 40 has a force amplifying effect, and thus a counterweight component 42 having a light weight can be used to provide a relatively greater acting force F2.

In order to decouple the radial sealing force between the wraps 156, 166 from the rotating speed of the driveshaft 30, the acting force F2 provided by the leverage mechanism 40 may be configured to have a direction substantially opposite to a direction of the centrifugal force of the orbiting scroll 160 and a value substantially equal to the centrifugal force of the orbiting scroll 160. Further, assuming that a predetermined angle is provided between the plane at which the flat portion 321 of the eccentric crank pin 32 is located and the plane at which the groove 323 is located (or assuming that the eccentric crank pin 32 has an effective driving angle $\theta_{eff}$), the radial sealing force between the wraps 156, 166 may be only provided by the radial component of the driving force determined by the predetermined angle or the effective driving angle $\theta_{eff}$, and is irrelevant to the centrifugal force of the orbiting scroll 160.

Figure 7:
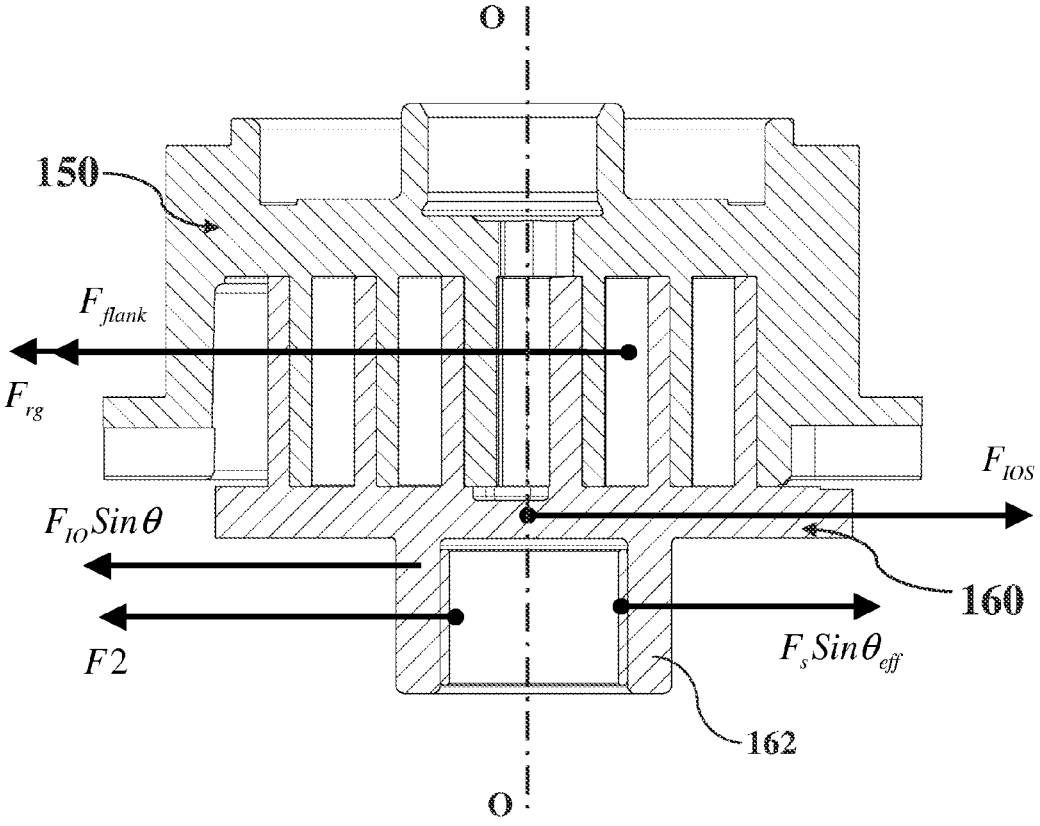
FIG. 7 is a cross-sectional view of a radial sealing force between the orbiting scroll and the non-orbiting scroll of the compressor of FIG. 3.

As shown in FIG. 7, in the scroll compressor of FIG. 3, the total radial sealing force between the non-orbiting scroll 150 and the orbiting scroll 160 may be expressed by the following formula:

$$F_{flank}=F_{IOS}+F_s \sin\theta_{eff}-F_{IO}*\sin\theta-F_{rg}-F2 \quad \text{Formula (2)}$$

where F2 is the centrifugal force provided by the counterweight component 42.

As can be known from the Formula 2, although both $F_{IOS}$ and F2 are items relevant to the rotating speed of the driveshaft 30, a difference between $F_{IOS}$ and F2 (that is, $F_{IOS}$–F2) is substantially zero by configuring $F_{IOS}$ and F2 to have substantially same value and opposite direction. In particular, regardless of the rotating speed of the driveshaft 30, the difference ($F_{IOS}$–F2) between $F_{IOS}$ and F2 is always substantially zero. Therefore, the above Formula 2 can be simplified to the following Formula 3:

$$F_{flank}=F_s \sin\theta_{eff}-F_{IO}*\sin\theta-F_{rg} \quad \text{Formula (3)}$$

In Formula 3, only $F_{IO}*\sin\theta$ is an item relevant to the rotating speed of the driveshaft 30. However, since the Oldham coupling 190 has a very small weight, item $F_{IO}*\sin\theta$ can almost be ignored. $F_{rg}$ is an item irrelevant to the rotating speed of the driveshaft 30, and thus can be regarded as a constant value. $F_s \sin\theta_{eff}$ is also an item irrelevant to the rotating speed of the driveshaft 30, and thus can be regarded as a constant value in the case that the effective driving angle $\theta_{eff}$ is fixed.

Therefore, the radial sealing force $F_{flank}$ of the compressor of FIG. 3 becomes a constant value irrelevant to the rotating speed of the driveshaft 30. In other words, regardless of the rotating speed of the driveshaft 30, the radial sealing force $F_{flank}$ will not be affected by the rotating speed of the driveshaft 30. On the other hand, since the value of $F_s \sin\theta_{eff}$ can be changed by changing the effective driving angle $\theta_{eff}$ of the eccentric crank pin 32, the desirable radial sealing force $F_{flank}$ can be obtained by adjusting the effective driving angle $\theta_{eff}$. Therefore, whether the scroll compressor is in the working condition of low rotating speed or the working condition of high rotating speed, an appropriate radial sealing force may be realized, thereby avoiding the reduced efficiency of the compressor due to the insufficient radial sealing force and over abrasion of the scroll component due to the excessive radial sealing force. On the other hand, since there is no need to consider the change in the radial sealing forces between the orbiting and non-orbiting scrolls 160, 150 of the compressor under the working condition of low rotating speed and the working condition of high rotating speed when designing the compressor, the design of the compressor can be simplified, thereby reducing the cost of the compressor.

Although in the above examples, a balancing force provided by the leverage mechanism 40 is set to be substantially equal to the centrifugal force of the orbiting scroll 160, the balancing force provided by the leverage mechanism 40 can also be set to be smaller than the centrifugal force of the orbiting scroll 160 to partially balance the centrifugal force of the orbiting scroll 160. Under this circumstance, the effect of the change of the rotating speed of the compressor on the radial sealing force between the orbiting and non-orbiting scrolls 160, 150 can be reduced, thereby reducing the difference of the radial sealing forces between the orbiting and non-orbiting scrolls 160, 150 under the working condition of low rotating speed and the working condition of high rotating speed, and also avoiding the poor sealing performance of the compressor under the working condition of low rotating speed and the overly abrasion of the compressor under the working condition of high rotating speed.

The weight and volume of the counterweight component 42, provided for balancing the centrifugal force of the orbiting scroll component, can be remarkably reduced compared to conventional counterweights. In addition, due to the bent portion 422 of the counterweight component 42, the center of gravity G of the counterweight component 42 is offset outwardly, which is equivalent to increasing the revolution radius of the center of gravity G of the counterweight component 42. Therefore, when comparing two counterweight components having the same weight, the one with a bent portion 422 may provide greater centrifugal force than the counterweight component without the bent portion. By providing the sleeve 50 at the journal portion 36 of the driveshaft 30, the main bearing 144 is prevented from being affected by the groove 323 of the driveshaft 30. In the compressor of the present disclosure, cooperation between the eccentric crank pin and the unloader bushing provides radial compliance for the compressor.

In the present disclosure, the leverage mechanism 40 is provided in the groove 323 of the driveshaft 30, thus the above beneficial effects can be realized with little or no modifications other components of the compressor, thereby reducing the modification cost of the compressor.

Figure 8:
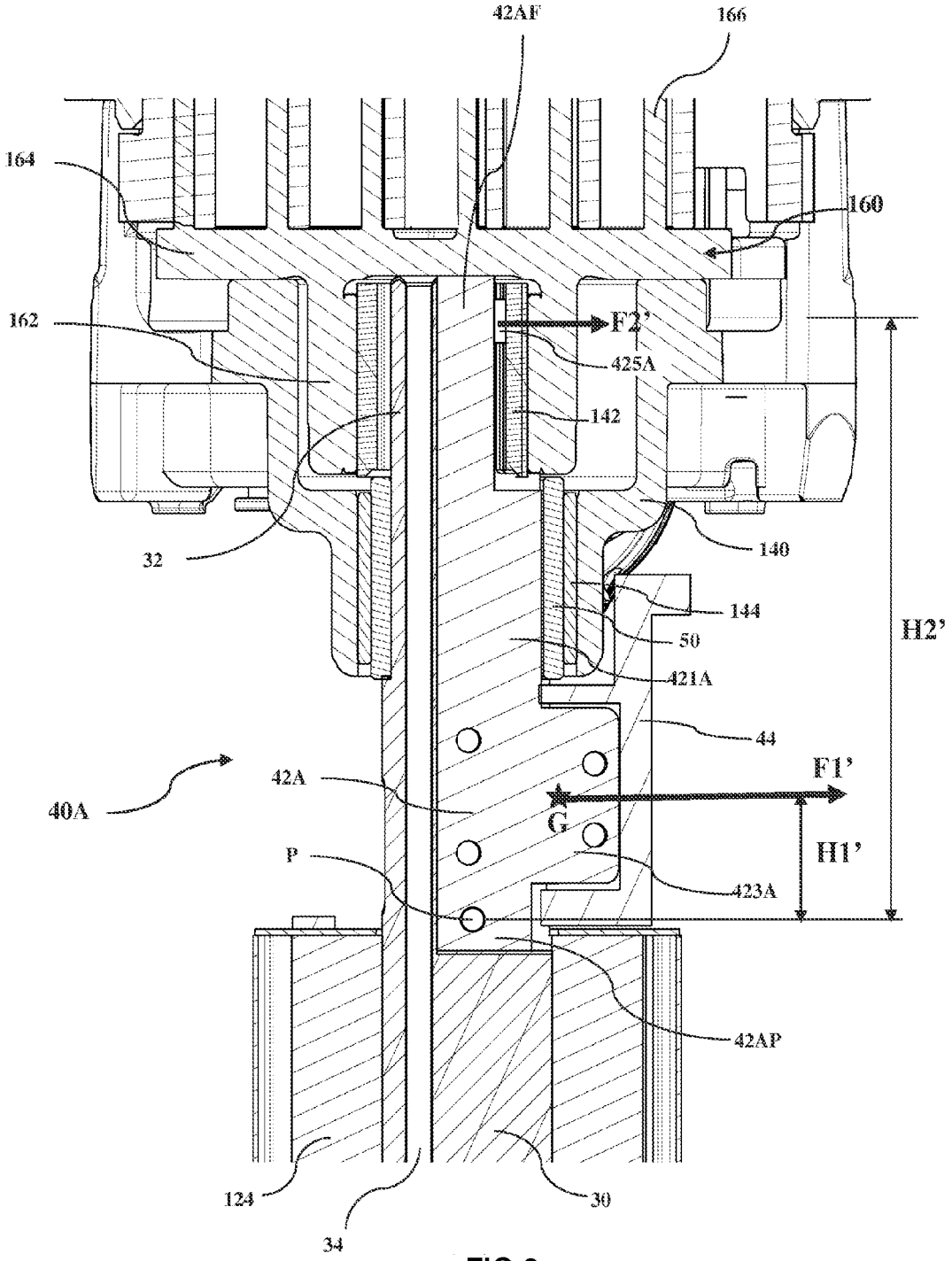
FIG. 8 is a partial cross-sectional view of another compressor having a leverage mechanism according to the principles of the present disclosure.

With reference to FIG. 8, another leverage mechanism 40A is provided. In the configuration shown in FIG. 8, the leverage mechanism 40A includes a counterweight component 42A. The counterweight component 42A includes a contact point (a contact portion) 425A for transmitting the centrifugal force to the orbiting scroll 160. In the present example, a center of gravity G of the counterweight component 42A is located between the contact point 425A and the pivot point P. That is to say, the pivot point P is located away from the distal end of the eccentric crank pin 32. Similar to the configuration of FIGS. 3-8, the counterweight component 42A may include a pivot end 42AP and a free end 42AF. The pivot end 42AP of the counterweight component 42A may be pivotally provided in the groove 323 of the driveshaft 30 via a pin-hole fit which forms the pivot point P.

The counterweight component 42A may include a first portion 421A substantially extending in the first direction parallel to the rotating axis of the driveshaft 30 and a second portion 423A extending in the second direction substantially vertical to the first direction. In the present example, assuming that a centrifugal force generated by the rotating counterweight component 42A is F1', an acting force transmitted to the orbiting scroll 160 via the contact point 425A is F2', a distance between the center of gravity G of the counterweight component 42A and the pivot point P is H1', a distance between the contact point 425A and the pivot point P is H2', and it can be known according to the leverage principle that the relationship between the above parameters is F1'*H1'=F2'*H2', i.e. F2'=F1'*(H1'/H2'). Similarly, it can be known from the above formula that a desirable value of the F2' may be obtained by appropriately determining at least one parameter of H1', H2' and F1'. However, in the present example, since H2' is larger than H1', the leverage mechanism 40A has a force reducing effect, and thus a counterweight component 42A having a greater weight is needed to provide a sufficient centrifugal force. To this end, in the leverage mechanism 40A of the present example, a second counterweight 44 may be connected to the counterweight component 42A to increase the centrifugal force provided by the leverage mechanism 40A. For example, the second counterweight 44 may be fixed to the second portion 423A of the counterweight component 42A by welding or a fastener.

Figure 9:
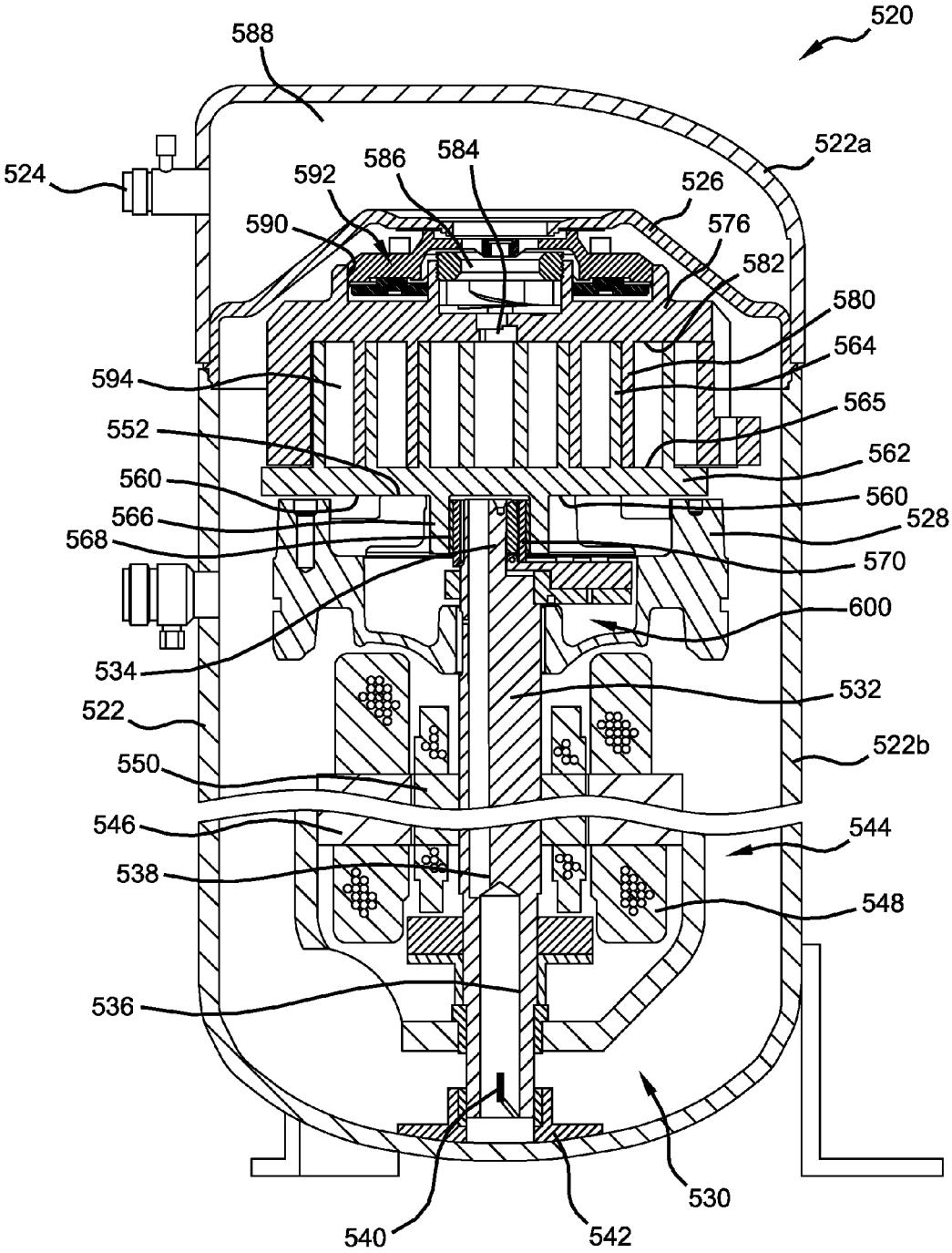
FIG. 9 is a cross-sectional view of a scroll compressor according to the present teachings.

Referring now to FIG. 9, another exemplary scroll compressor 520 according to the present teachings is provided. The compressor 520 includes a shell 522 that can have an upper portion 522*a* attached to a lower portion 522*b* in a sealed relationship. The shell 522 can be generally cylindrical. The upper shell 522*a* can be provided with a refrigerant discharge fitting 524. A transversely extending partition 526 can be welded about its periphery at the same point the upper shell 522*a* is welded to the lower shell 522*b*. A stationary main bearing housing or body 528 and a lower bearing assembly 530 can be secured in the shell 522. A driveshaft 532 having an eccentric drive pin 534 at the upper end thereof can be rotatably journaled in the main bearing housing 528 and in the lower bearing assembly 530. The driveshaft 532 can have at the lower end a relatively large diameter concentric bore 536 which communicates with a radially outwardly inclined small diameter bore 538 extending upwardly therefrom to the top of driveshaft 532. A stirrer 540 can be disposed within the bore 536. The lower portion of lower shell 522*b* can form a sump which can be filled with lubricant to a certain level. The bore 536 can act as a pump to pump lubricating fluid up the driveshaft 532 and into the bore 538 and, ultimately, to various portions of the compressor that require lubrication. A strainer 542 can be attached to the lower portion of the shell 522*b*. The strainer 542 can direct the lubricant flow into the bore 536.

The driveshaft 532 can be rotatably driven by an electric motor 544 disposed within the lower bearing assembly 530. The electric motor 544 can include a stator 546, windings 548 passing therethrough, and a rotor 550 rigidly mounted on the driveshaft 532.

The upper surface of main bearing housing 528 can include a flat thrust-bearing surface 552. The thrust-bearing surface 552 can axially support a lower surface 560 of an orbiting scroll member 562. The orbiting scroll member 562 can include a spiral vane or wrap 564 extending axially upwardly from an upper surface 565 thereof. A cylindrical hub 566 can project downwardly from the lower surface 560 of the orbiting scroll member 562. The cylindrical hub 566 can have a drive bearing 568 and an unloader bushing 570 therein. The eccentric drive pin 534 can be drivingly disposed within the unloader bushing 570. The eccentric drive pin 534 can have a flat on one surface that drivingly engages a flat surface 572 (FIG. 11) formed in a portion of the unloader bushing 570 to provide a radially compliant drive arrangement, such as shown in Assignee's U.S. Pat. No. 4,877,382, entitled "Scroll-Type Machine with Axially Compliant Mounting," the disclosure of which is herein incorporated by reference.

A non-orbiting scroll member 576 can also be provided having a spiral vane or wrap 580 extending downwardly from a lower surface 582 that can be positioned in meshing engagement with the wrap 564 of the orbiting scroll member 562. The non-orbiting scroll member 576 can have a centrally disposed discharge passage 584 that communicates with an upwardly open recess 586 which, in turn, can be in fluid communication with a discharge muffler chamber 588 defined by the upper portion 522*a* and the partition 526. An annular recess 590 can also form in the non-orbiting scroll member 576 within which is disposed a floating seal assembly 592. The recesses 586 and 590 and the seal assembly 592 can cooperate to define axial pressure biasing chambers, which receive pressurized fluid being compressed by the wraps 564 and 580. The biasing chambers can exert an axial biasing force on the non-orbiting scroll member 576 to thereby urge the tips of the respective wraps 564, 580 into sealing engagement with the opposed end plate surfaces 582 and 565.

An Oldham coupling can be positioned between and keyed to the orbiting scroll member 562 and non-orbiting scroll member 576 to prevent rotational movement of the orbiting scroll member 562. The Oldham coupling may be of the type disclosed in the above-referenced U.S. Pat. No. 4,877,382; however, other Oldham couplings, such as the coupling disclosed in Assignee's U.S. Pat. No. 6,231,324, entitled "Oldham Coupling for Scroll Machine," the disclosure of which is hereby incorporated by reference, may also be used.

The orbiting scroll member 562 can orbit relative to the non-orbiting scroll member 576 and cause the respective wraps 564, 580 to move relative to one another and form compression cavities/pockets 594 which can progressively diminish in volume to compress the fluid therein. The compression cavities 594 can be formed between the wraps 564, 580. During operation, the fluid can be sucked into the scroll set at a suction pressure adjacent the periphery of the orbiting scroll member 562. The fluid can then be compressed to the discharge pressure by the progressively diminishing size of compression cavities 594. The fluid can then be discharged through the discharge passage 584 in the center of the non-orbiting scroll member 576. Because the pressure of the fluid being compressed within the intermeshing wraps 564, 580 increases as the fluid advances toward the center of the non-orbiting scroll member 576, the axial force from the compressed fluid is greatest adjacent the discharge passage 584 and is lower adjacent the periphery of the orbiting scroll member 562 wherein the fluid is at suction pressure.

Figure 10:
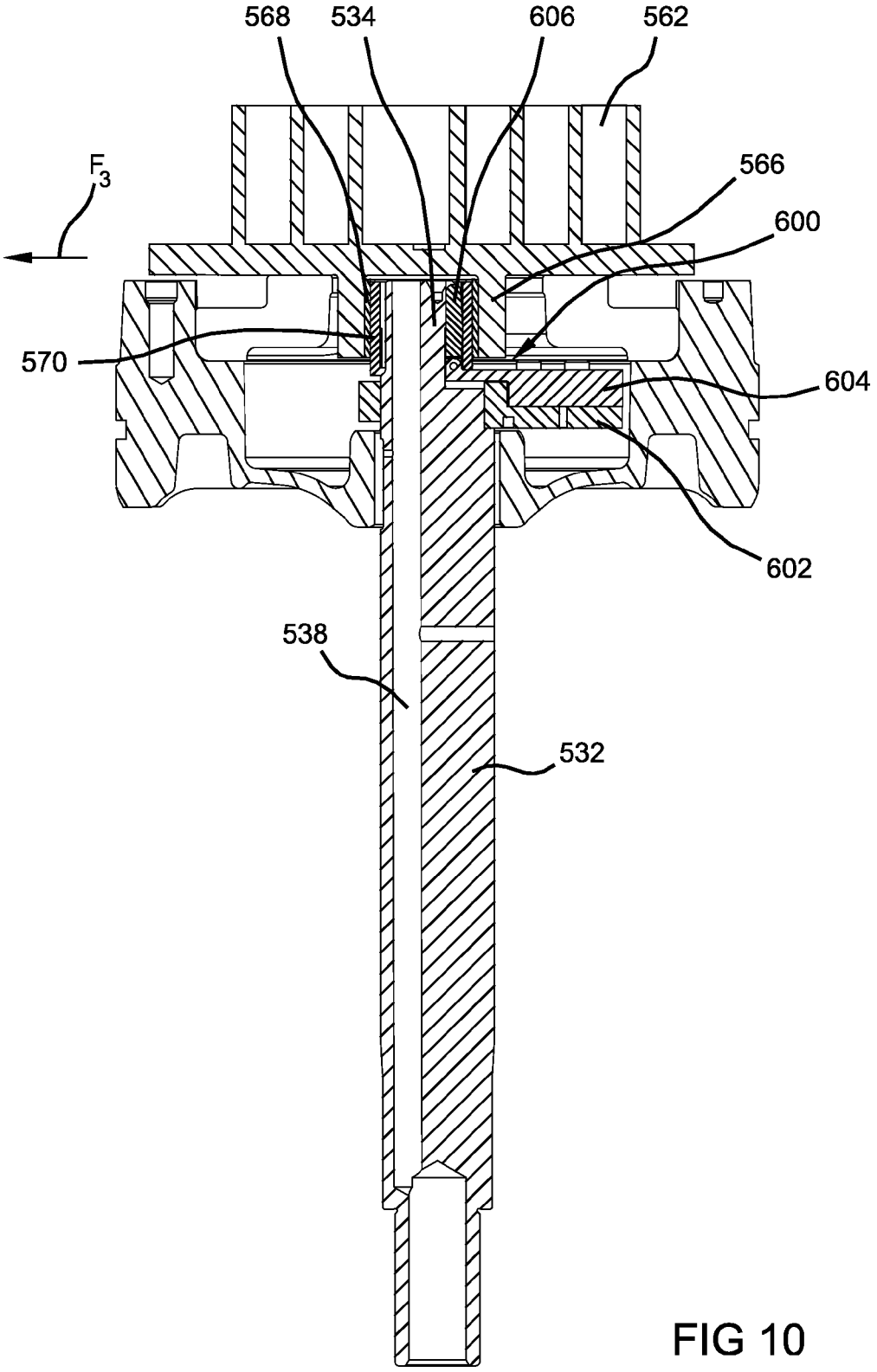
FIG. 10 is an enlarged view of a portion of the compressor of FIG. 9 showing details of an orbiting scroll member and a counterweight assembly.
Figure 11:
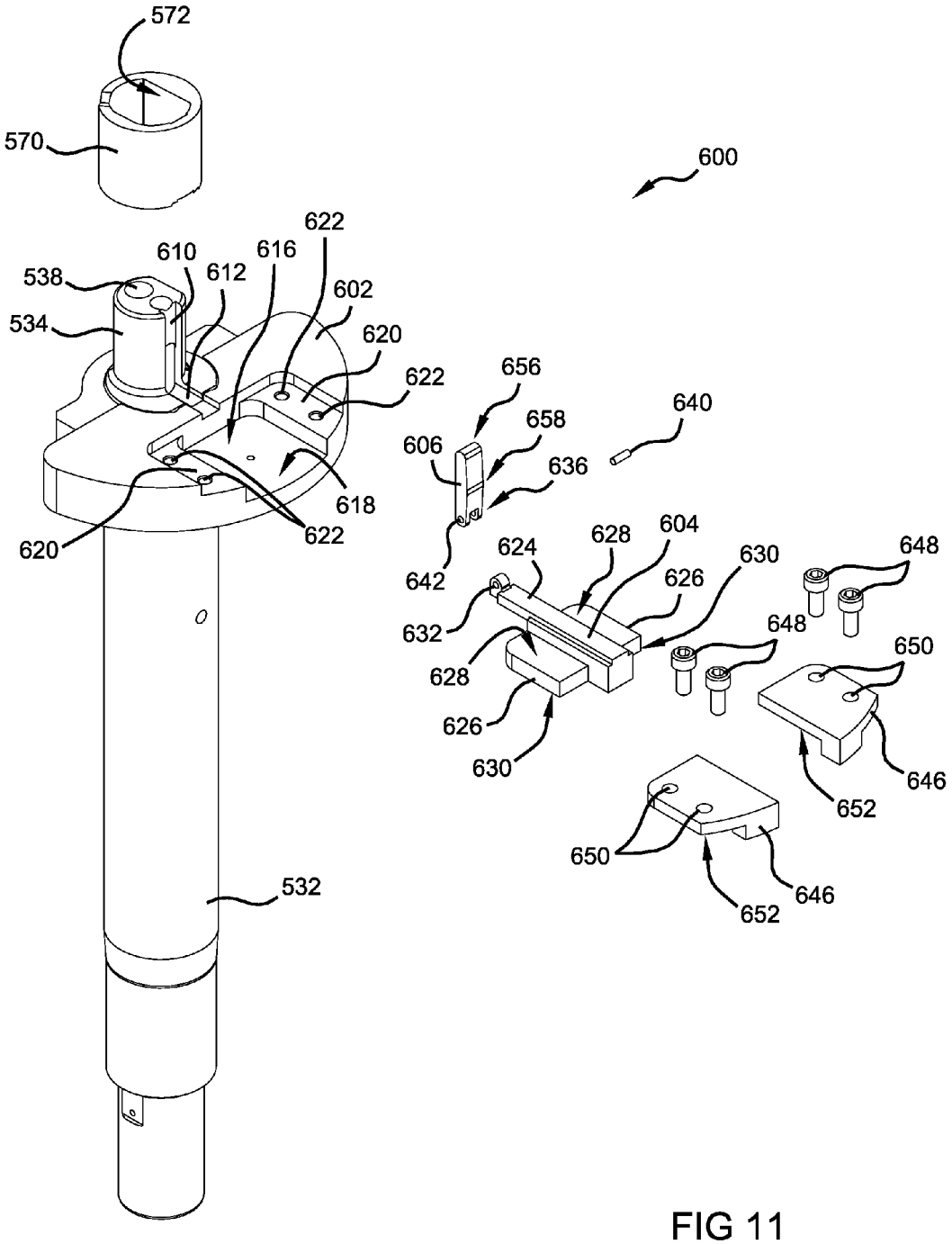
FIG. 11 is an exploded view of the driveshaft and counterweight assembly.
Figure 12:
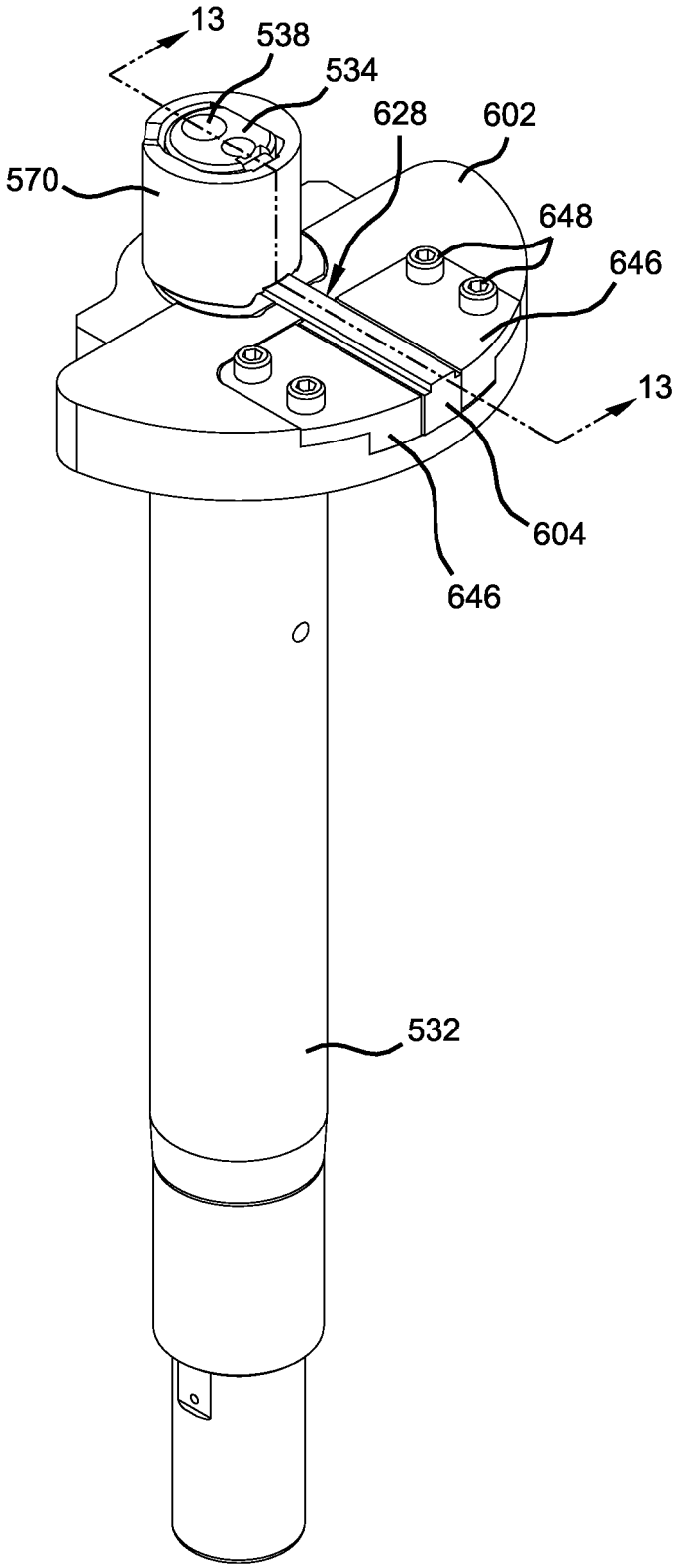
FIG. 12 is an assembled view of the driveshaft and counterweight assembly of FIG. 11.
Figure 13:
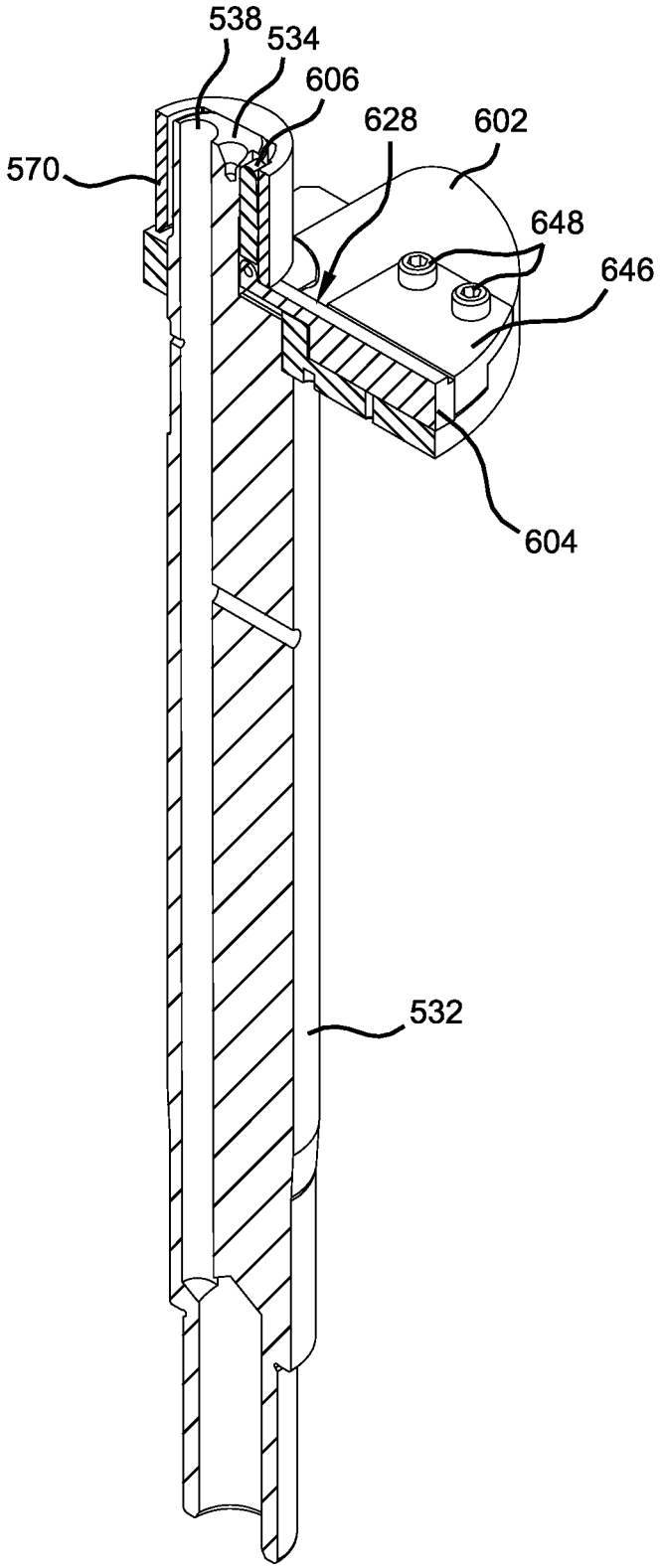
FIG. 13 is a cross-sectional view of the driveshaft and counterweight assembly taken along line 13-13 of FIG. 12.

With continued reference to FIG. 9 and additional reference to FIGS. 10 and 11, additional features of the compressor 520 will be described. The compressor 520 can include a counterweight assembly 600. The counterweight assembly 600 can generally include a first counterweight 602, a second counterweight 604, and a lever 606. The first counterweight 602 can be fixed for rotation with the driveshaft 532. The first counterweight 602 can define a mass that acts to oppose an inertial force $F_3$ created by the orbiting scroll member 562 during operation of the scroll compressor 520. A first notch 610 (FIG. 11) can be defined axially along the eccentric drive pin 534. A second notch 612 can be defined along a portion of the first counterweight 602. The first and second notches 610 and 612 can intersect to collectively form an L-shaped notch. The first counterweight 602 can define a retaining area 616. The retaining area 616 can define an upper slide surface 618 and a pair of opposing shelves 620. Blind bores 622 can be defined in each of the opposing shelves 620. In one example, the blind bores 622 can be threaded.

The second counterweight 604 can include a central body portion 624 and a pair of opposite fins 626. Each of the fins 626 can define upper slide surfaces 628 and lower slide surfaces 630, respectively. An eyelet 632 can be defined at an end of the second counterweight 604. The second counterweight 604 can be pivotally linked to a first portion 636 of the lever 606. In one example, an axle 640 can extend cooperatively through the eyelet 632 of the second counterweight 604 and a pair of bores 642 formed in the lever 606. A portion of the central body portion 624 can partially nest within the second notch 612 while the lever 606 partially nests within the first notch 610.

A pair of retainers 646 can be fixed to the first counterweight 602 by way of fasteners 648. In one example, the fasteners 648 can extend through apertures 650 defined in the retainers 646. The fasteners 648 can be threadably received by the blind bores 622 of the first counterweight 602. The retainers 646 can collectively define a retainer slide surface 652. The retainers 646 can define an upper boundary of the second counterweight 604 to confine the second counterweight 604 at the retaining area 616.

The lever 606 can further define a second portion 656 and an intermediate portion 658. The lever 606 can be generally curved such that the intermediate portion 658 is offset from a line extending through the first and second portions 636 and 656, respectively.

Figure 14:
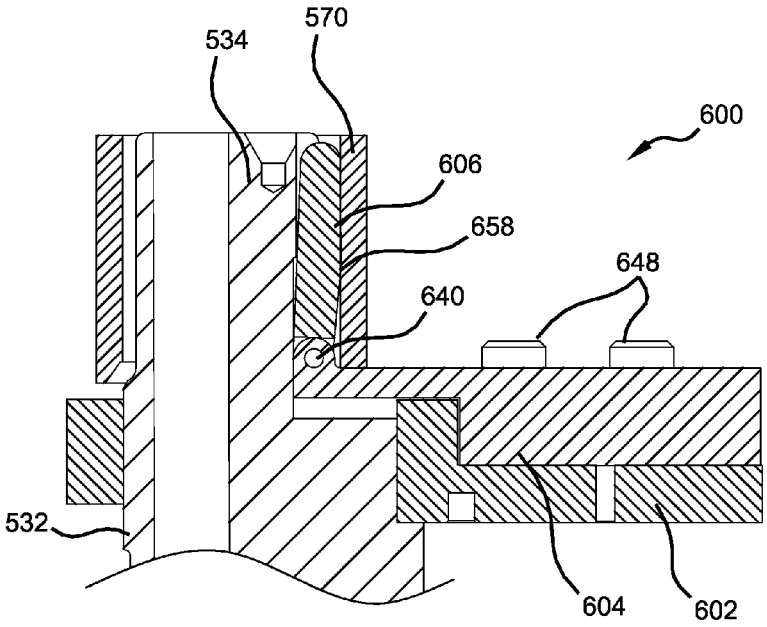
FIG. 14 is a cross-sectional view of the counterweight assembly in a static position.
Figure 15:
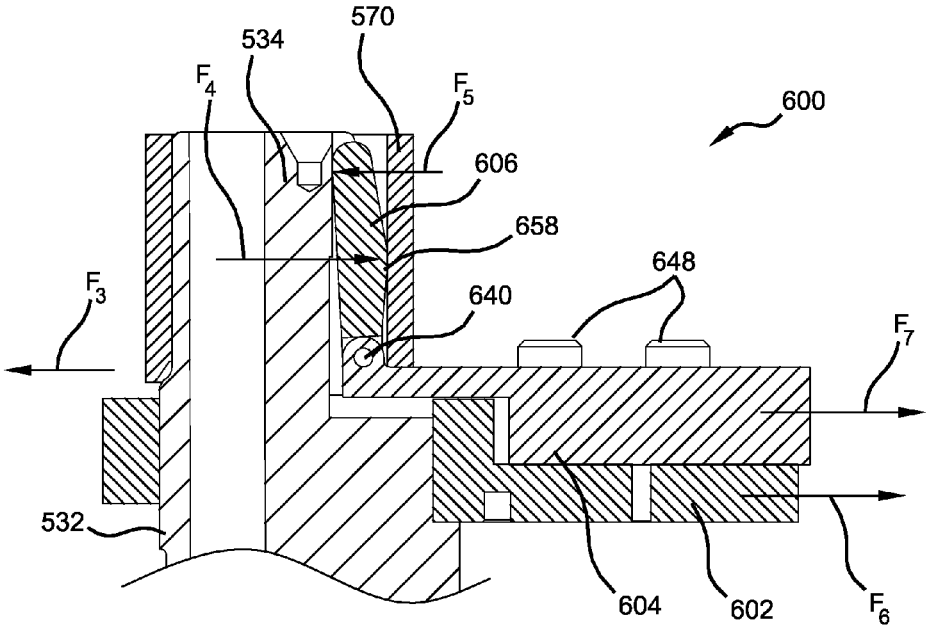
FIG. 15 is a cross-sectional view of the counterweight assembly during operation of the scroll compressor.

With reference now to FIGS. 14 and 15, operation of the counterweight assembly 600 will be described. In general, the second counterweight 604 can rotate with the first counterweight 602 and the driveshaft 532 during rotation of the driveshaft 532. When the driveshaft 532 reaches a predetermined rotational speed, the second counterweight 604 can translate (slide) in a radially outward direction along the first counterweight slide surface 618 in a direction away from the inertial force $F_3$ (FIG. 15) of the orbiting scroll member 562. In this way, the second counterweight 604 can be mounted for movement relative to the first counterweight 602. Correspondingly, the second counterweight 604 can be mounted for movement relative to the orbiting scroll member 562.

During translation of the second counterweight 604, the upper slide surfaces 628 of the fins 626 can slide along the slide surfaces 652 of the retainers 646. Similarly, the lower slide surfaces 630 can slide along the first counterweight slide surface 618. Likewise, the central body portion 624 can slide between the retainers 646. It is appreciated that while the second counterweight 604 has been described as sliding along respective surfaces of the retainers 646 and the first counterweight 602, the second counterweight 604 can alternatively slide adjacent to some or all of these surfaces. Explained differently, the second counterweight 604 does not necessarily contact each of the opposing surfaces.

Translation of the second counterweight 604 in the radially outward direction can cause the lever 606 to pivot about the axle 640 and rotate in a counterclockwise direction (as viewed by FIG. 15). A first lever force $F_4$ can be transferred onto the unloader bushing 570 at the intermediate portion 658 of the lever 606. A second lever force $F_5$ can be transferred onto the eccentric drive pin 534. As illustrated in FIG. 15, the inertial force $F_3$ (shown in a direction generally leftward) of the orbiting scroll member 562 can be opposed by a first counterforce $F_6$ (shown in a direction generally rightward) of the first counterweight 602 and a second counterforce $F_7$ (shown in a direction generally rightward) of the second counterweight 604.

During compressor operation, inertial force $F_7$ of the second counterweight 604 can be transferred through the axle 640, through the lever 606 and to the unloader bushing 570. The inertial force $F_7$ of the second counterweight 604 can then be transferred through the drive bearing 568 (FIG. 9) to the orbiting scroll member 562. By proper orientation of the lever 606 and the second counterweight 604, the inertial force $F_3$ of the orbiting scroll member 562 may be partially compensated by the counterforce $F_7$ of the second counterweight 604 (in addition to the counterforce $F_6$ of the first counterweight 602), thus reducing force and friction experienced by the wraps 564, 580. As a result, decreased loads between the wraps 564 and 580 of the respective orbiting scroll member 562 and non-orbiting scroll member 576 can be achieved with the counterweight assembly 600, thereby improving the overall efficiency of compressor 520.

Figure 16:
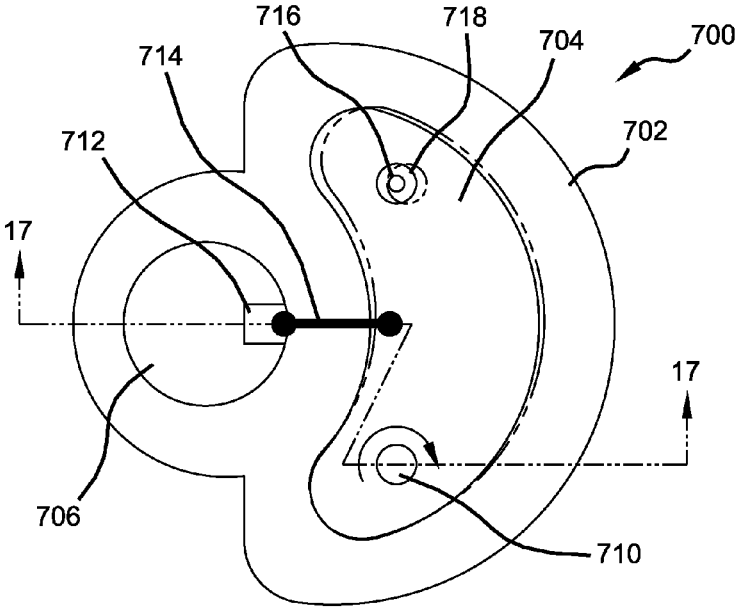
FIG. 16 is a top view of a counterweight assembly according to additional features.
Figure 17:
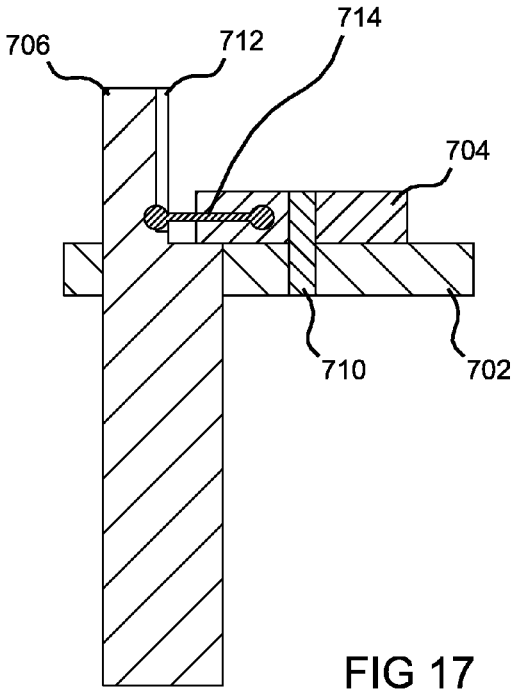
FIG. 17 is a cross-sectional view taken along line 17-17 of FIG. 16.

Turning now to FIGS. 16 and 17, a counterweight assembly 700 according to additional features is shown. The counterweight assembly 700 can generally include a first counterweight 702 and a second counterweight 704. The first counterweight 702 can be coupled to a driveshaft 706. The second counterweight 704 can be pivotally coupled to the first counterweight 702 by a pin 710. A lever 712 can be connected with the second counterweight 704 by a link 714. A post 716 can extend from the first counterweight 702 through an aperture 718 in the second counterweight 704. During rotation of the driveshaft 706, inertial force of the second counterweight 704 will cause the second counterweight 704 to rotate in a clockwise direction around pin 710 from a position generally identified in solid line to a position generally identified in phantom line as shown in FIG. 16. Further rotation of the second counterweight 704 in the clockwise direction is precluded by interaction between the post 716 and the aperture 718 formed in the second counterweight 704. The resulting force applied to the lever 712 from the link 714 can be represented by the following formula:

$$F = A * \omega^2 \pm B * \frac{d\omega}{dt}$$

where F is the resultant force; w is the angular speed of the driveshaft 706; and $$\frac{d\omega}{dt}$$

is the angular acceleration of the driveshaft 706.

By properly selecting the mass, center of gravity and moment of inertia of the counterweights 702 and 704, as well as the location of the pin 710 and the link 714 attachment point, it is possible for those skilled in the art to select the desired values of parameters A and B. Specifically, it is possible to have the value for parameter B to be both positive and negative, i.e., to provide an additional component of the radial unloading either during acceleration or deceleration, depending on the desired operation. For example, a positive value of B may be needed in order to provide radial unloading during start up to make the motor 544 start easier. In another example, a negative value of B may be needed, if radial unloading is required during shutdown to prevent or at least reduce reverse rotation and achieve quiet shutdown.

While the present teachings are shown in exemplary fashion by referring to the compressor illustrated in the figures, it should be appreciated that the same can take various forms and still be within the scope of the present teachings. For example, other configurations for the second counterweight are contemplated. In one example, the second counterweight can be configured to swing radially outward rather than slide over the first counterweight. In such a configuration, by properly selecting weight, moment of inertia, location of a swing pin and the location of the link attachment to the counterweight, excessive flank force can be compensated while using the effect of angular shaft acceleration of the flank force in a desirable manner. In one example, angular deceleration can be determined at shutdown and the scrolls can be radially unloaded to prevent reverse rotation. Additionally, it should be appreciated that the directional indicators (e.g., leftward and rightward) used herein refer to the exemplary force directions and are not absolute directional indicators. Thus, it should be appreciated that changes in the configurations shown can be employed without deviating from the spirit and scope of the present teachings. Such variations are not to be regarded as a departure from the spirit and scope of the claims.

What is claimed is:

1. A compressor comprising:

a compression mechanism including orbiting and non-orbiting scroll members meshingly engaging each other;

a driveshaft having an eccentric crank pin engaging said orbiting scroll member such that rotation of said driveshaft about a first axis causes orbital motion of said orbiting scroll relative to said non-orbiting scroll; and a lever mounted to said driveshaft for rotation with said driveshaft about said first axis, said lever rotatable coupled to said driveshaft by a pin that extends through an aperture in said lever such that said lever is rotatable about said pin relative to said driveshaft about a second axis that extends through said pin and is perpendicular to said first axis.

2. The compressor of claim 1, wherein at least a portion of said lever is disposed between an unloader bushing and said eccentric crank pin in a radial direction.

3. The compressor of claim 2, wherein said eccentric crank pin moves in a radial direction relative to said unloader bushing in response to rotation of said lever about said second axis.

4. The compressor of claim 1, wherein said second axis extends through the eccentric crank pin.

5. The compressor of claim 1, wherein a center of gravity of said lever is radially offset relative to said second axis.

6. The compressor of claim 1, further comprising:

a first counterweight mounted for movement with said orbiting scroll member and producing a first counterforce that acts against an inertial force of said orbiting scroll member; and a second counterweight mounted for movement with said orbiting scroll member and producing a second counterforce that acts against said inertial force of said orbiting scroll member, wherein said lever is mounted between said first and second counterweights, and wherein movement of said lever transfers a first lever force onto said orbiting scroll, said first lever force acting substantially against said inertial force.

7. The compressor of claim 6, wherein said second counterweight moves relative to said first counterweight and in an operating direction radially opposite to a direction of said inertial force of said orbiting scroll member during orbital motion of said orbiting scroll member.

8. The compressor of claim 6, wherein said lever defines a first portion, a second portion and an intermediate portion, said intermediate portion being offset from a line passing through said first and second portions, wherein said lever is pivotally coupled to said second counterweight at said first portion.

9. The compressor of claim 8, wherein movement of said second counterweight in an operating direction causes said second portion of said lever to impart a second lever force onto said eccentric drive pin, said second lever force acting substantially in said direction of said inertial force.

10. The compressor of claim 1, further comprising a counterweight component mounted for radial movement relative to said orbiting scroll member and producing a counterforce that acts against said inertial force of said orbiting scroll member, wherein said lever is pivotally coupled to said counterweight and rotates upon radial movement of said counterweight to transfer a first lever force against said inertial force.

11. The compressor of claim 1, wherein at least a portion of said lever is disposed between a hub of said orbiting scroll and said eccentric pin in a radial direction.

12. The compressor of claim 1, wherein at least a portion of said lever is disposed within a groove formed in said driveshaft.

13. The compressor of claim 12, wherein the groove is formed in the eccentric crank pin.

14. The compressor of claim 13, wherein the groove extends into a concentric portion of the driveshaft.

15. The compressor of claim 14, wherein said lever includes a generally vertically extending portion and a generally horizontally extending portion, wherein said horizontally extending portion extends radially out of said groove, and wherein said vertically extending portion is disposed radially between said driveshaft and a bearing supporting the driveshaft for rotation about said first axis.

16. A compressor comprising:

a compression mechanism including orbiting and non-orbiting scroll members meshingly engaging each other;

a driveshaft having an eccentric crank pin engaging said orbiting scroll member such that rotation of said driveshaft about a first axis causes orbital motion of said orbiting scroll relative to said non-orbiting scroll; and a lever mounted for rotation with said driveshaft about said first axis and rotatable relative to said driveshaft about a second axis, wherein at least a portion of said lever is disposed between a hub of said orbiting scroll and said eccentric pin in a radial direction.

17. The compressor of claim 16, wherein at least a portion of said lever is disposed between an unloader bushing and said eccentric crank pin in a radial direction.

18. The compressor of claim 17, wherein said eccentric crank pin moves in a radial direction relative to said unloader bushing in response to rotation of said lever about said second axis.

19. The compressor of claim 16, wherein at least a portion of said lever is disposed within a groove formed in said driveshaft.

20. The compressor of claim 19, wherein the groove is formed in the eccentric crank pin.

21. The compressor of claim 20, wherein the groove extends into a concentric portion of the driveshaft.

22. The compressor of claim 21, wherein said lever includes a generally vertically extending portion and a generally horizontally extending portion, and wherein said horizontally extending portion extends radially out of said groove.

23. The compressor of claim 22, wherein said vertically extending portion is disposed radially between said driveshaft and a bearing supporting the driveshaft for rotation about said first axis.

24. The compressor of claim 16, wherein said second axis extends through the eccentric crank pin.

25. The compressor of claim 16, wherein a center of gravity of said lever is radially offset relative to said second axis.

26. A compressor comprising:

a compression mechanism including orbiting and non-orbiting scroll members meshingly engaging each other;

a driveshaft having an eccentric crank pin engaging said orbiting scroll member such that rotation of said driveshaft about a first axis causes orbital motion of said orbiting scroll relative to said non-orbiting scroll; and a lever mounted for rotation with said driveshaft about said first axis and rotatable relative to said driveshaft about a second axis, wherein at least a portion of said lever is disposed within a groove formed in said driveshaft.

27. The compressor of claim 26, wherein the groove is formed in the eccentric crank pin.

28. The compressor of claim 27, wherein the groove extends into a concentric portion of the driveshaft.

29. The compressor of claim 28, wherein said lever includes a generally vertically extending portion and a generally horizontally extending portion, and wherein said horizontally extending portion extends radially out of said groove.

30. The compressor of claim 29, wherein said vertically extending portion is disposed radially between said driveshaft and a bearing supporting the driveshaft for rotation about said first axis.

31. The compressor of claim 26, wherein said second axis extends through the eccentric crank pin.

32. The compressor of claim 26, wherein a center of gravity of said lever is radially offset relative to said second axis.

* * * * *